United States Patent [19]

Schrock

[11] Patent Number: 4,937,982

[45] Date of Patent: Jul. 3, 1990

[54] POSITIONING APPARATUS FOR TOOL SHARPENING

[76] Inventor: Raymond V. Schrock, 553 Woods Dr., San Marcos, Calif. 92069

[21] Appl. No.: 264,826

[22] Filed: Oct. 31, 1988

[51] Int. Cl.[5] ..... B24B 41/00

[52] U.S. Cl. ..... 51/225; 51/218 T; 51/259; 51/238 T

[58] Field of Search ..... 51/277, 218 T, 219 R, 51/220, 225, 259, 288 T, 239

[56] References Cited

U.S. PATENT DOCUMENTS

| | | | |
|---|---|---|---|
| 2,035,163 | 3/1936 | Holmberg | 51/225 |
| 2,118,912 | 5/1938 | Armitage | 51/225 |
| 2,156,034 | 4/1939 | Thomas | 51/238 T |
| 3,030,744 | 4/1962 | Mueller | 51/225 |
| 3,352,068 | 11/1967 | Rocheleau | 51/225 |
| 3,494,080 | 2/1970 | LaGuna | 51/219 R |

FOREIGN PATENT DOCUMENTS

| | | | |
|---|---|---|---|
| 1161648 | 2/1984 | Canada | 51/168 |

*Primary Examiner*—Robert Rose

*Attorney, Agent, or Firm*—Brown, Martin, Haller & McClain

[57] ABSTRACT

A positioning apparatus includes a guide frame with a mounting assembly for mounting the frame on the end face of a tool holder so that it projects transversely away from the holder. A levelling or positioning member is slidably mounted in the frame for movement in a first direction towards and away from the tool holder, and a locking device locks the levelling member in a selected position. A key indent at one end of the member locates a cutting edge at the end of a cutting tool mounted in the tool holder. The key indent is adjustable in position in a second direction perpendicular to the first.

14 Claims, 3 Drawing Sheets

POSITIONING APPARATUS FOR TOOL SHARPENING

BACKGROUND OF THE INVENTION

The present invention relates generally to a positioning fixture or apparatus for accurately positioning a tool having end cutting parts or cutting edges on its end face, such as an end mill, counterbore or spot facer, prior to a grinding or sharpening operation for sharpening the cutting edges of the tool.

The end cutting parts of tools such as end mills become dull after a period of use, and must then be sharpened. The cutting edges or ends of the flutes must be ground in a level position to obtain the desired cutter geometry. In the machine shop, such tools are normally positioned by eye prior to sharpening. However, this procedure is inconvenient and usually not accurate enough to ensure that the geometry of clearances can be accurately repeated from one tool to another.

SUMMARY OF THE INVENTION

It is an object of the present invention to provide a positioning fixture or apparatus for accurately positioning a tool such as an end mill prior to a sharpening operation.

According to the present invention, a positioning apparatus for positioning a tool having end cutting edges prior to a sharpening operation comprises a guide frame with a mounting assembly for mounting the guide frame on the end of a tool holder such as a collet assembly so that it projects transversely from the end face of the collet, a slide member slidably mounted in the guide frame for movement towards and away from the tool holder and a centering or levelling device mounted on the slide member. The levelling device has a flat end face or levelling plate at one end for locating a cutting edge on the end face of a cutting tool mounted in the chuck. A first directional adjustment of the position of the levelling plate is provided by moving the slide member relative to the guide frame. This moves the levelling plate towards and away from the end face of the collet. A second adjustment mechanism is provided for adjusting the position of the levelling plate in a second direction perpendicular to the first adjustment direction. The second adjustment mechanism may comprise an adjustable sliding engagement between the levelling device and slide member. Suitable locking devices are provided for locking or locating the levelling device in its adjusted positions in each of the two adjustment directions.

The positioning device can therefore be accurately moved to the position of one of the cutting edges of a tool mounted in a collet chuck or other holding device, by mounting the frame on the end of a collet sleeve and adjusting the position of the levelling plate in two perpendicular directions until the cutting edge rests against the levelling plate. The levelling plate is then locked in this position, and removed from the chuck while the cutting edges are sharpened. A cutting edge of another tool can then be located in exactly the same position as the first edge simply by mounting the device on the chuck and rotating and positioning the tool until an edge of the second tool rests on the levelling plate, before tightening the tool in the chuck. The device is again removed and the second tool is sharpened. The procedure can be repeated over and over. Prior to locating and sharpening the first cutting edge, the levelling plate can be levelled relative to the collet assembly or tool holder using a level. For example, an indexing pin having a flat may be mounted in the collet assembly and the flat positioned with a level. The positioning device can then be adjusted so that the levelling plate is located against the flat of the pin.

Preferably, the mounting assembly is adjustable to allow the guide frame to be moved across the end face of the collet sleeve in a third direction relative to the first two directions. In this case, the guide frame can first be positioned on the mounting assembly so that the levelling plate is aligned with the indexing pin, and the levelling plate can then be adjusted in two perpendicular directions until it rests against the flat of the pin. Alternatively, the mounting assembly may be designed to locate the guide frame in a fixed position relative to the collet sleeve so that the levelling plate is centered on a plane passing through the center axis of the sleeve, and can be adjusted in two perpendicular directions in that plane to rest against a tool or indexing pin mounted in the collet sleeve.

Preferably, the levelling plate includes a key indent for locating the cutting edge. In the preferred embodiment, the levelling plate includes oppositely directed key indents for locating the cutting edges of the ends of tools having both left and right handed pitch.

In the preferred embodiment, the mounting assembly comprises a first mounting bar for mounting against the end face of a tool holding apparatus such as a collet, and a second mounting bar projecting from the guide frame in a direction transverse to the guide frame, the two mounting bars having slidably interengageable formations for slidably mounting the guide frame on the first mounting bar, and an adjustable stop for adjusting the position of the guide frame on the first mounting bar. Preferably, the guide frame is freely suspended on the first mounting bar by a hook-like interengagement between the first and second mounting bars, without any positive connection between the first and second mounting bars which would otherwise have to be repeatedly released and re-connected as successive cutting edges are positioned. The guide frame is simply hung on the first mounting bar to position a tool in the collet, then lifted off while the located cutting edge is sharpened, and hung back on the mounting bar to position the next cutting edge.

This arrangement allows the ends of end mills and similar tools to be ground or sharpened much more accurately, quickly and easily than by previous techniques. The cutting edges or ends of the flutes can be quickly and repeatedly located with precision using the positioning apparatus.

BRIEF DESCRIPTION OF THE DRAWINGS

The present invention will be better understood from the following detailed description of a preferred embodiment, taken in conjunction with the accompanying drawings, in which like reference numerals refer to like parts, and in which.

DESCRIPTION OF THE PREFERRED EMBODIMENT

Figure 1:
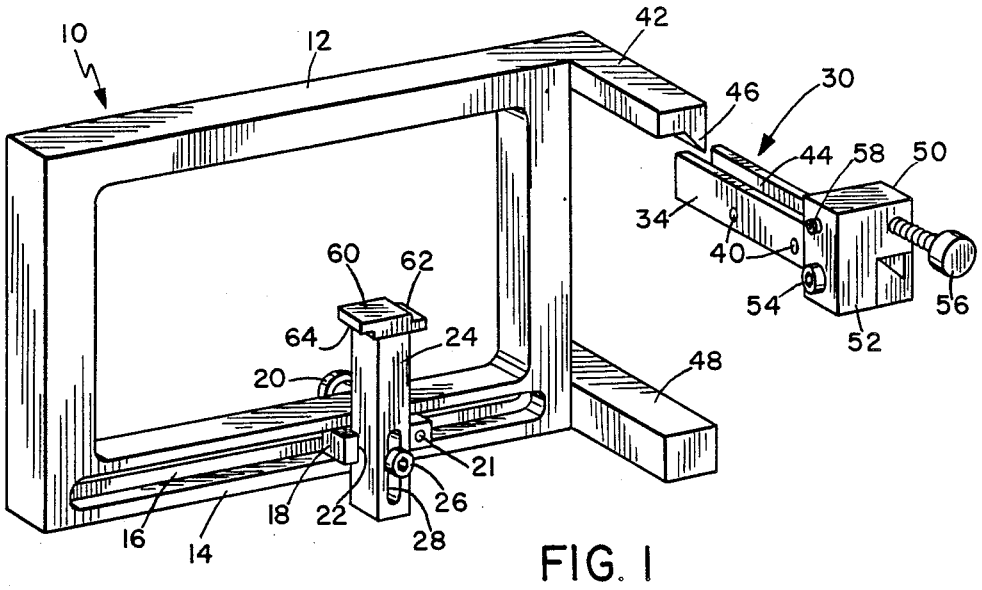
FIG. 1 is a perspective view of the positioning apparatus according to a preferred embodiment of the present application.

FIG. 1 illustrates a preferred embodiment of the positioning apparatus or fixture 10 according to the present invention. As illustrated in FIG. 1, the apparatus comprises a guide frame 12 of generally rectangular outline having a first side comprising a guide bar 14 with a slot 16 extending along its length to define a first adjustment direction, as will be explained below. A slide member 18 is slidably mounted in the slot 16, and a locking screw or bolt 20 is provided for releasably locking the member 18 in a selected location in slot 16. Bolt 20 engages in a corresponding bore 21 in the slide member when tightened to lock the slide member in position in the slot 16.

The member 18 projects transversely to one side of the slot 16, and an indent or mounting slot 22 extends across the end of member 18 in a direction transverse to slot 16 to define a second adjustment direction A positioning or levelling post 24 is slidably mounted in mounting slot 22. Levelling post bolt 26 extends through an elongate slot 28 in the post to engage a threaded bore (not visible in the drawings) at the inner end of slot 22 to lock the post in a selected position relative to slot 22.

Figure 2:
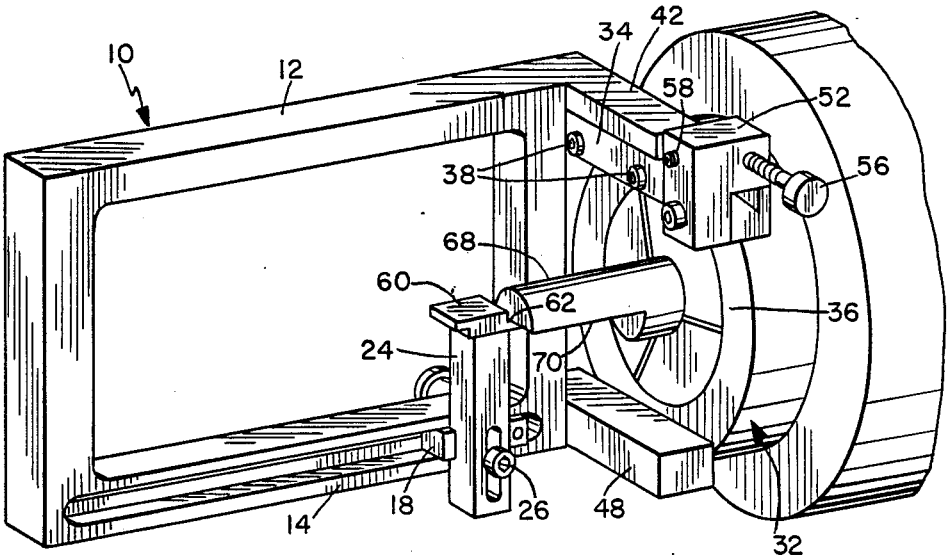
FIG. 2 is a perspective view of the apparatus mounted on a collet assembly, showing the initial set up and alignment.
Figure 3:
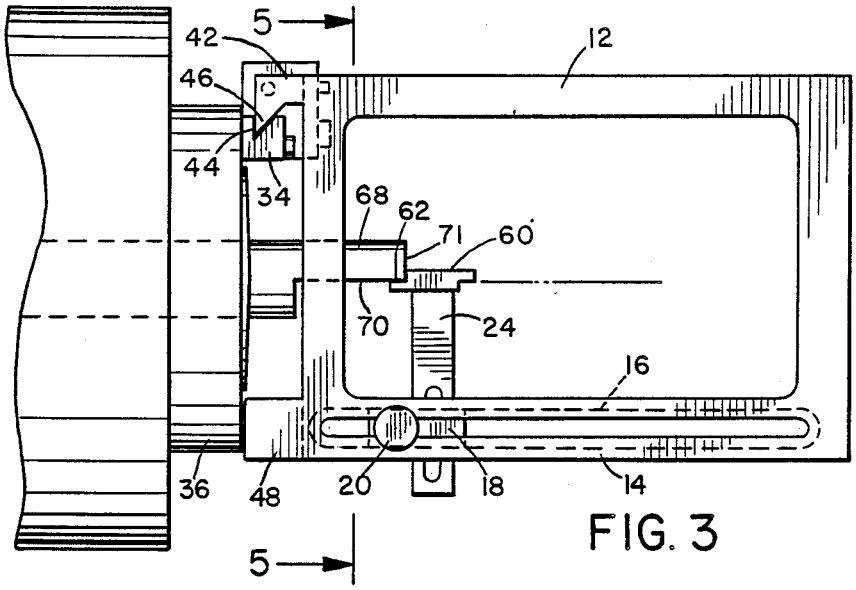
FIG. 3 is a side elevation view of the structure of FIG. 2.

A mounting assembly 30 is provided for releasably mounting the guide frame on the end face of a collet assembly 32, as illustrated in FIG. 2, or on the end face of any suitable tool holder designed to hold a tool with a cylindrical shank during a machining operation. The mounting assembly comprises a first mounting bar 34 which is secured to the end face of the collet sleeve 36 by any suitable means, such as screws 38 extending through openings 40, or by pins, welding, or adhesives, and a second mounting bar 42 which projects transversely from one corner of the guide frame remote from the slotted side bar 14. The mounting bar 34 has a groove or channel 44 which is designed to face upwardly when the bar is secured to the collet sleeve as illustrated in FIG. 2, while the second mounting bar 42 has a downwardly projecting rail or projection 46 for slidable engagement in channel 44, as illustrated in FIG. 3. In the illustrated embodiment the channel and slide rail are of slidably interfitting, generally V-shaped or angled configuration. However, any suitable interfitting configurations may be used for these parts of the device which will allow bar 42 to be hung freely on bar 44 and lifted off when positioning is complete. A centering or locating bar or foot 48 extends parallel to mounting bar 42 from the opposite corner of the frame at the adjacent end of guide slot, for resting against the sleeve when the guide frame is mounted on the collet assembly as illustrated in FIG. 2, so that the guide frame is held perpendicular to the front face of sleeve 36.

Figure 7:
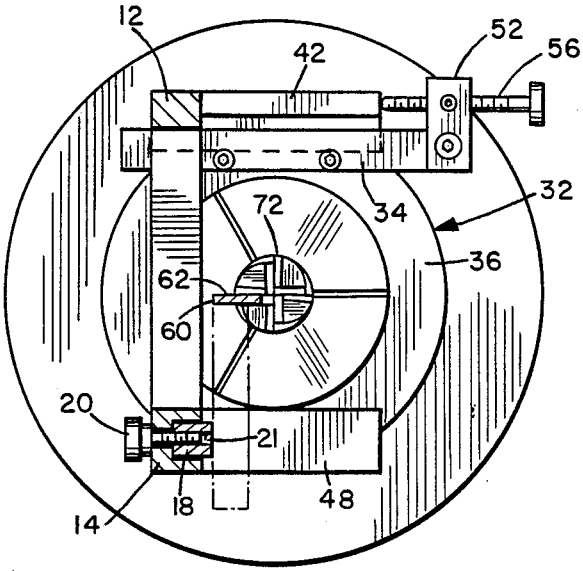
FIG. 7 is a sectional view taken on line 7—7 of FIG. 6.

An adjustable stop 50 is mounted at one end of mounting bar 34 for engaging the free end of the mounting bar 42 when it is slid into channel 36, thus controlling the position of the guide frame on the mounting bar 34. The engagement between the mounting bars 34 and 42 defines a third adjustment direction perpendicular to the first two directions defined by slots 16 and 22, respectively. The stop comprises a block 52 mounted at one end of bar 34 via mounting bolt 54, and a stop screw 56 extending through the block 52 parallel to channel 36 to engage the free end of bar 42 when it is inserted into the channel, as best illustrated in FIG. 7. In this way, the position of the end of bar 42 in channel 36, and thus the location of the guide frame relative to the end face of the collet, can be adjusted by extending or retracting stop screw 56. A holding screw 58 extends transversely into the block 52 for releasable locking engagement with stop screw 56 to hold it in a selected position. Stop screw or gauge 56 may be provided with an indexing or calibration scale, and similar numbered scales may be provided along slots 16 and 28 if desired.

The levelling post 24 extends transverse to guide slot 16 and has a levelling or indexing plate 60 at one end with at least one key or corner indent 62 extending along one side of the plate for locating a cutting edge at the end of a tool such as an end mill. Preferably the plate has a second key or corner indent 64 facing in the opposite direction to first indent 62 for locating the cutting edges of end mills of reverse pitch, as will be explained below. Each key or corner indent is generally L-shaped, consisting of a flat base portion 65 and a transverse shoulder or stop portion 66 projecting outwardly from the base portion, and is suitably formed by cutting out an L-shaped indent or notch along one side edge of a flat plate-like member. To form the oppositely directed notches or indents, a first notch is formed on one face of the plate along one side edge, while the second notch is formed on the other face of the plate to extend along the opposite side edge.

Figure 4:
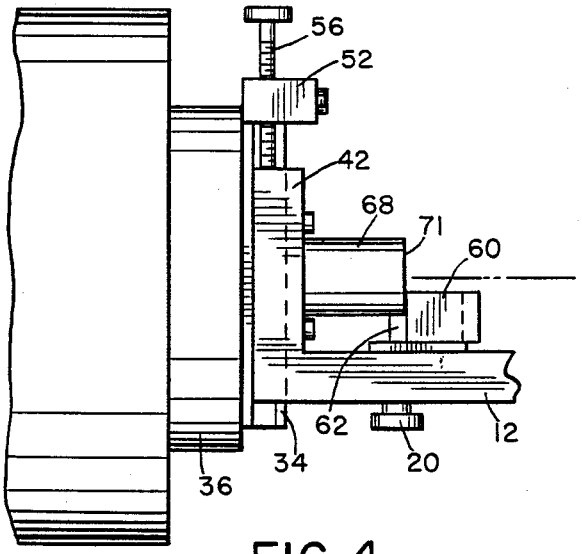
FIG. 4 is a top plan view of a portion of FIG. 3.
Figure 5:
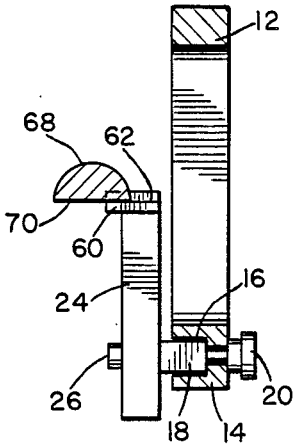
FIG. 5 is a sectional view taken on line 5—5 of FIG. 3.

The initial set up of the positioning apparatus relative to a collet assembly or any suitable tool holder for holding an end mill or similar tool having a cylindrical shank on a fixed axis will now be described in more detail, with reference to FIGS. 2 to 4.

First, the mounting bar 34 is secured to the end face of the collet sleeve or other tool holder so that it will not interfere with the removal of the collet. A level is held on the bar, and the sleeve is seated into place while holding it level, so that the bar is in a horizontal, level orientation as indicated in FIG. 2.

Subsequently, a cylindrical pin or indexer 68, which has been flat ground to center to form diametrical flat 70 extending from one end, is inserted in the collet with the flat facing down. The flat is positioned using a level so that it is also in a horizontal, level orientation. The collet is then tightened.

The guide frame is then hung onto the end of the collet as illustrated in FIG. 2 by hooking the angled rail 46 into the slide channel 44, allowing foot 48 to rest against a lower portion of the sleeve 36. This ensures that the frame extends perpendicular to collect sleeve 36 and guide bar 14 projects horizontally in a direction perpendicular to mounting bar 34. Stop or indexer screw 56 is retracted. Screw 56 may be numbered for calibration purposes, in which case it is retracted to a zero position. Locking bolts 20 and 26 are also loosened to allow slide member 18 to move freely along slot 16, and post 24 to move downwardly along slot 22.

At this point bar 42 can be slid along channel 44 and slide member 18 can be moved along slot 16 until the levelling plate is located directly under the flat 70. Stop screw 56 is advanced to contact the end face of bar 42 in this position, and holding screw 58 is tightened to hold the stop screw in its adjusted position. Similarly, bolt 20 is tightened to lock the slide member in position.

The center post is then pushed up until the levelling plate contacts the pin as illustrated in FIG. 2, with the end 71 of the pin resting in indent 62 up against stop 66 and flat 70 resting on surface 65 (see FIG. 3).

The post bolt 26 is then tightened. The frame and levelling post can now be lifted off the collet assembly, with the levelled position maintained for future operations.

It will be understood that the foregoing description relates to the positioning of the indent 62 for positioning the cutting edges of right handed tools. Indent or locating face 64 can be positioned by turning pin 68 so that flat 70 faces upwardly, and rotating post 24 180 degrees about its axis so that indent 64 faces the collet. The center post can then be positioned with the levelling plate above pin 68, and can be lowered into contact with flat 70 before tightening bolt 26.

The positioning fixture is now ready to be used to position a tool having end cutting edges for sharpening, such as an end mill. The fixture can be used with a tool having any number of flutes.

Figure 6:
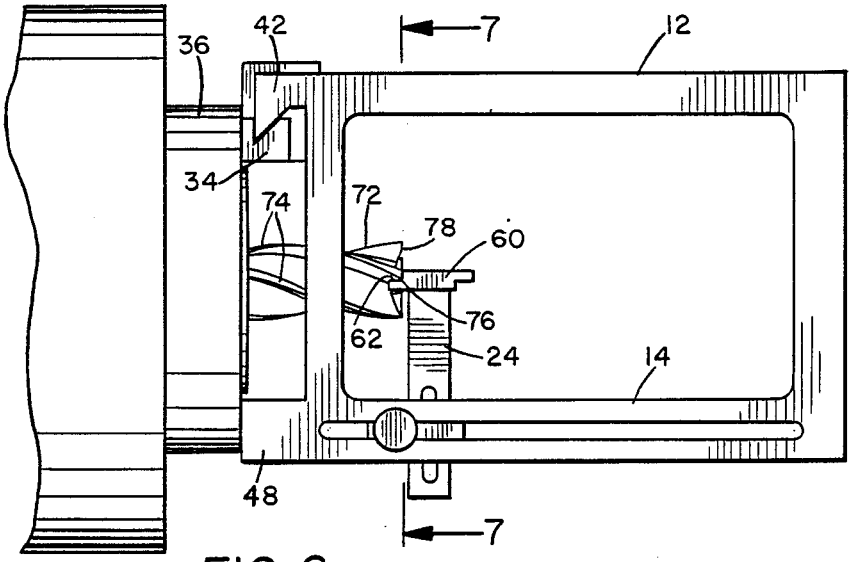
FIG. 6 is a view similar to FIG. 3, but showing an end mill in the collet positioned by the apparatus.
Figure 8:
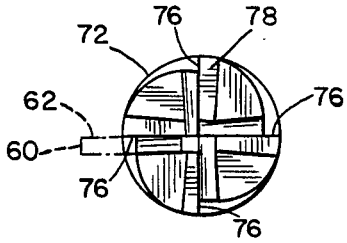
FIG. 8 is an enlargement of a portion of FIG. 7, showing the indexing of the end mill.

The tool is first inserted into the collet or tool holder. FIGS. 6 to 8 illustrate an end mill 72 with four right handed flutes 74 ending in cutting edges 76.

The frame 12 is then hung on the mounting bar 34, and slid to the right as viewed in FIG. 7 until the end of bar 42 contacts the stop screw 56. The end mill 72 is now pulled out and rotated until the end of a flute rests on the indent 62 in the levelling plate with its end face or land 78 butting up against stop or shoulder 66, as illustrated in FIG. 6. The collet is then tightened, and the frame is lifted out of the way. At this point, the cutting edge to be sharpened will be level and at a predetermined distance from the front face of the collet.

A suitable grinding or sharpening tool of a type known in the field can now be used to sharpen the located cutting edges. This allows the cutting edges of tools be properly and repeatedly located in a substantially identical levelled orientation, at the same distance from the collet end face, making the grinding operation much quicker and easier to perform.

Figure 9:
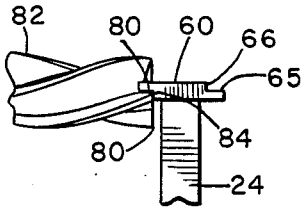
FIG. 9 is a side elevation view showing the levelling plate reversed to align an end mill with left hand or reversed pitch.

FIG. 9 illustrates the set up of the levelling post 24 for positioning the cutting edges 80 of a tool 82 with left hand or reversed pitch. The center post will be rotated 180 degrees before securing it loosely in mounting slot 22, prior to initial set up of the fixture, so that left hand indent 64, which faces downwardly, faces towards the collet. Once the center post has been positioned relative to the collet and removed, the tool is inserted in the manner described above and rotated until one of the cutting edges rests in indent 64 in the position shown in FIG. 9, with end face or land 84 butting up against shoulder 66. The collet is tightened and the frame removed prior to sharpening the positioned edges.

The indexing indents 62 and 64 ensure that an operator can position end mills, or other tools, in a collet with the cutting edges repeatedly at the same distance out from the collet and level, a procedure which previously had to be done by eye or by other less convenient and more time consuming means. This positioning fixture thus improves the results when sharpening or re-grinding cutting tools such as end mills, spot facers, counter bores and the like, and makes the procedure much easier and faster to perform.

Although a preferred embodiment of the invention has been described above by way of example only, it will be understood by those skilled in the field that modifications may be made to the disclosed embodiment without departing from the scope of the invention, which is defined by the appended claims.

I claim:

1. A positioning apparatus for positioning a tool having end cutting edges on an axial end face thereof in a tool holder prior to a grinding operation for sharpening the end cutting edges, the apparatus comprising:

a guide member;

a mounting assembly for releasably mounting the guide member on an end face of a tool holder so that the guide member projects transversely away from the end face in a first direction;

slide means slidably mounted in the guide member for movement towards and away from the tool holder in said first direction;

first locking means for locking said slide means in a selected position relative to said tool holder;

levelling means slidably mounted in said slide means for movement in a second direction perpendicular to said first direction, said levelling means having a keying end portion for seating an end cutting edge of a tool mounted in said holder, said keying end portion including stop means for controlling the distance of said end cutting edge away from said holder end face; and second locking means for locking said keying end portion in a selected position relative to said slider means

2. The apparatus as claimed in claim 1, wherein said mounting assembly includes adjustment means for adjusting the position of said guide member relative to said tool holder in a third direction perpendicular to said first and second directions.

3. The apparatus as claimed in claim 1, wherein said slide member has a channel extending in said second direction, and said levelling means is slidably mounted in said channel and having key means at one end, said channel.

4. The apparatus as claimed in claim 1, wherein said levelling means comprises an elongate member and said keying end portion has an L-shaped indent defining said stop means.

5. The apparatus as claimed in claim 4, wherein said keying end portion comprises a flat plate having an indent in one face extending along one side edge and an indent in its opposite face extending along the opposite side edge, one of said indents comprising right hand key means for locating the downwardly directed cutting edges of a right hand cutting tool mounted in said tool holder and the other of said indents comprising left hand key means for locating the upwardly directed cutting edges of a left hand cutting tool.

6. The apparatus as claimed in claim 1, wherein said keying and portion includes first key means for locating the cutting edges on a cutting tool of right hand pitch and second key means for locating the cutting edges of a cutting tool of left hand pitch.

7. The apparatus as claimed in claim 1, wherein said guide member comprises a frame having one side defining a guide arm, said guide arm having a slot extending along its length, and said slide means being slidably mounted in said slot.

8. The apparatus as claimed in claim 6, wherein said mounting assembly comprises a first mounting bar for mounting on an end face of a tool holder to define a third adjustment direction perpendicular to said first two directions, and a second mounting bar extending perpendicular to said guide frame in said third direction, said mounting bars having slidably interengageable formations for slidably mounting said guide frame on said first mounting bar, and said adjustment means comprising means for positioning the guide frame relative to said first mounting bar.

9. The apparatus as claimed in claim 8, wherein said first mounting bar has a channel and said second mounting bar has a rail for sliding engagement in said channel, said adjustment means comprising a stop adjustably mounted in said channel for engaging the end of said second mounting bar, and locking means for locking said stop in a selected position in said channel.

10. The apparatus as claimed in claim 1, wherein said mounting assembly comprises a first part for mounting on an end face of the tool holder, and a second part projecting from said guide frame in a direction perpendicular to said first direction, said first part having a channel, said second part having hanger means for freely suspending said guide member from said channel, and stop means for freely locating at end of said second part in a selected position in said channel.

11. The apparatus as claimed in claim 1, wherein said guide member comprises a rectangular frame, one side wall of said frame having an elongate slot extending along its length, said slide means being slidably mounted in said slot, said mounting assembly comprising a first part having a slide channel for mounting on the end face of a tool holder and a second part comprising a slide rail for sliding engagement in said channel projecting from a corner of said frame remote from said wall in a direction perpendicular to said frame.

12. The apparatus as claimed in claim 11, said mounting assembly further including a foot bar projecting from said frame parallel to said slide rail at a location spaced from said corner for resting against the end face of a tool when said slide rail is engaged in said channel.

13. A positioning apparatus for positioning a workpiece having end cutting edges on an axial end face thereof in a workpiece holder having an end face from which the workpiece projects prior to a grinding operation, the apparatus comprising:

a guide frame having a first, elongate guide bar with a guide slot extending along the bar to define a first adjustment direction;

a mounting assembly for releasably supporting the guide frame on an end face of a tool holder with the guide bar projecting transversely away from the end face;

a slide member slidably mounted in the guide slot and having a portion projecting transversely to one side of the slot;

a levelling member secured to the projecting portion of the slide member and extending transverse to the guide bar, the levelling member having a levelling plate at one end having locating key means for seating against an end cutting edge at the axial end face of a workpiece to control the distance of said end cutting edge from said workpiece holder end face;

releasable locking means for locking the slide member in a selected position in the guide slot;

and adjustment means for adjusting the position of the levelling plate relative to the chuck in a second direction perpendicular to said first adjustment direction.

14. A method of positioning the cutting edges at the end of a tool mounted in a tool holder prior to a sharpening operation, comprising the steps of:

securing the first part of a mounting assembly for mounting a positioning device on the end face of a tool holder to the end face in a level orientation;

suspending a guide member forming part of the positioning device from the first part of the mounting assembly so that it projects transversely away from the end face of the tool holder;

mounting a cylindrical pin in the tool holder, the pin having a flat diametrical cut out extending from one end;

levelling the flat surface of the pin and tightening it in the holder in its levelled position;

sliding a levelling member mounted in the guide member in a first direction towards and away from the tool holder, and sliding the guide member relative to the first part of the mounting assembly in a second direction across the end face of the tool holder until a key indent on the levelling member is aligned with the position of the flat surface;

locking the guide member and levelling member in the aligned position;

sliding the levelling member in a third direction relative to said guide member perpendicular to the first and second directions until the flat surface rests in said key indent;

locking the levelling member in its adjusted position relative to said third direction;

removing the guide member from the tool holder;

inserting a tool to be sharpened in the tool holder;

replacing the guide member on the holder;

adjusting the extension of the tool out of the holder and rotating the tool in the holder until one of its cutting edges rests in the key indent;

locking the tool in the adjusted position;

removing the guide member from the tool holder;

sharpening the positioned cutting edges.

* * * * *

UNITED STATES PATENT AND TRADEMARK OFFICE

CERTIFICATE OF CORRECTION

PATENT NO. : 4,937,982

DATED : July 3, 1990

INVENTOR(S) : Raymond V. Schrock

It is certified that error appears in the above-identified patent and that said Letters Patent is hereby corrected as shown below:

Column 6, claim 3, line 43, should read --in said channel and having said key means at on end.--; please delete second occurrence of ", said";

line 44, delete "channel."

Column 6, claim 6, line 60, "and" should be --end--;

Column 7, claim 10, line 28, "at" should be --an--;

Column 7, claim 13, line 47, "an" should be --its--; line 48, delete --thereof--.

Signed and Sealed this

Tenth Day of December, 1991

*Attest:*

HARRY F. MANBECK, JR.

*Attesting Officer*

*Commissioner of Patents and Trademarks*